United States Patent [19]

Takatsuka

[11] Patent Number: 4,861,029

[45] Date of Patent: Aug. 29, 1989

[54] RACKET FRAME

[75] Inventor: Masanori Takatsuka, Hamamatsu, Japan

[73] Assignee: Yamaha Corp., Japan

[21] Appl. No.: 148,902

[22] Filed: Jan. 27, 1988

[30] Foreign Application Priority Data

Jan. 26, 1987 [JP] Japan ..... 62-15726
Feb. 3, 1987 [JP] Japan ..... 62-23308

[51] Int. Cl.[4] ..... A63B 49/02

[52] U.S. Cl. ..... 273/73 C; 273/73 E; 273/73 R

[58] Field of Search ..... 273/73 R, 73 C, 73 D, 273/73

[56] References Cited

U.S. PATENT DOCUMENTS 3,734,499 5/1973 Goldstein ..... 273/73 E
4,029,317 6/1977 Malmström ..... 273/73 C
4,094,505 6/1978 Beall, Jr. ..... 273/73 C
4,139,194 2/1979 Fischer ..... 273/73 C
4,213,608 7/1980 Krishnan ..... 273/73 C
4,655,455 4/1987 Kurusu ..... 273/73 C

FOREIGN PATENT DOCUMENTS 431394 7/1935 United Kingdom ..... 273/73 C

*Primary Examiner*—Edward M. Coven
*Assistant Examiner*—Gary Jackson
*Attorney, Agent, or Firm*—Ostrolenk, Faber, Gerb & Soffen

[57] ABSTRACT

In construction of a racket frame, its head defining a face is made up of a plurality of elongated members coupled to each other in a manner to allow elastic deformation at shooting balls of the elongated members towards the center of the face so that impulsion caused by shooting balls should be shared by the head in order to mitigate impulsive load on strings forming the face.

9 Claims, 2 Drawing Sheets

RACKET FRAME

BACKGROUND OF THE INVENTION

The present invention relates to an improved racket frame, and more particularly relates to an improvement in construction of a racket frame head defining a face formed by a lattice work of tensioned strings.

Recent developments of racket frames cover a wide variety of types from wooden racket frames to metal racket frames to FRP racket frames. A wide variety of materials have been used for strings forming the face in the racket frame head.

Most conventional racket frames have a general construction in which a head is coupled to a grip via a yoke and has a substantially oval shape defining a face formed by a latticework of strings held in tension on the head. More specifically, the latticework is made up of two groups of strings, the first group of strings run in the longitudinal direction of the oval shape and the second group of strings run in the lateral direction of the oval shape.

In such racket frame heads, the closed construction of the head does not allow easy elastic deformation of the head towards the center of the face in response to impulsion caused by shooting balls. Thus, the impulsion caused by shooting balls is mostly incurred by the face defined by the head and elastic deformation of the face poses great mechanical load on the component strings. Since the impulsion cannot be shared by the head and is incurred by the face only, no great repulsion on balls can be expected. Due to generation of the great load on the strings, it is not possible to use high stiffness fibers such as aramid fibers and extra-high molecular compound polyethylene fibers which exhibit low energy loss.

SUMMARY OF THE INVENTION

It is the basic object of the present invention to mitigate the impulsive load on the strings of a racket frame face caused by shooting ball, and to enable free use of high stiffness fibers in tennis racket strings.

In accordance with the basic aspect of the present invention, the face of a racket frame head is defined by a plurality of elongated members coupled to each other in a manner to allow elastic deformation at shooting balls of the elongated members towards the center of the face.

DESCRIPTION OF THE PREFERRED EMBODIMENTS

Figure 1:
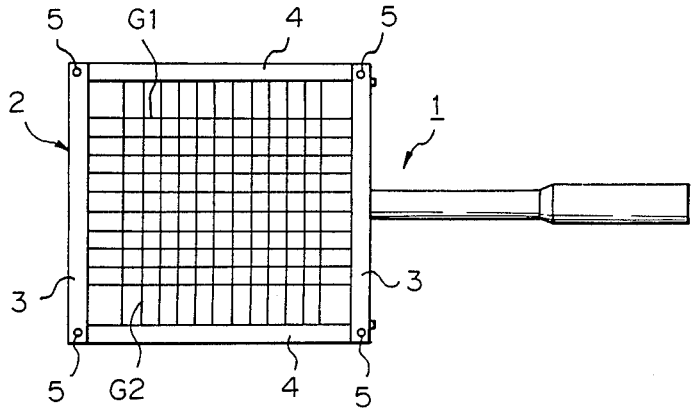
FIG. 1 is a simpified plan view of one embodiment of the racket frame in accordance with the present invention in a free state.

In FIG. 1, a head 2 of the racket frame 1 in accordance with the present invention has a substantially rectangular configuration defined by a pair opposed elongated members 3 to which are secured longitudinal strings G1 and a pair of opposed elongated members 4 for securing lateral strings G2. The four elongated members 3 and 4 are tunably coupled to each other at their ends by means of, for example, pins 5. As a substitute for the pins 5, the elongated members 3 and 4 may be coupled to each other by means of hinges. What is basically required is that the elongated members 3 and 4 should be turnable about the joints of coupling under application of an external force. In the assembled state shown in FIG. 1, the longitudinal strings G1 are held in tension between the pair of longitudinal members 3, the lateral strings G2 are held in tension between the pair of elongated members 4, and the longitudinal and lateral strings G1 and G2 form a face defined by the head 2.

Figure 2:
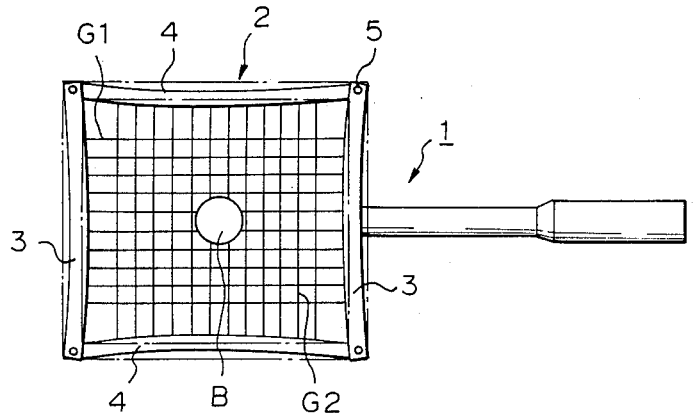
FIG. 2 is a simplified plan view of the racket frame in FIG. 1 with elastic deformation at shooting a ball.

As a ball B impinges on the face of the racket frame 1 as shown in FIG. 2, increased tension is generated on the strings G1 and G2 to pull the associated elongated members 3 and 4 towards the center of the face. Since the elongated members 3 and 4 can turn about the joints of coupling, the elongated members 3 and 4 exhibit elastic deformation towards the center of the face as shown with solid lines.

Due to such elastic deformation, the impulsion caused by shooting balls is incurred not only by the face but also by the head which is constituted by the elongated members. Such impulsion sharing greatly mitigates impulsive load on the strings, thereby providing increased repulsion of the balls. Reduction in impulsive load on strings allows free use of high stiffness fibers.

Figure 3:
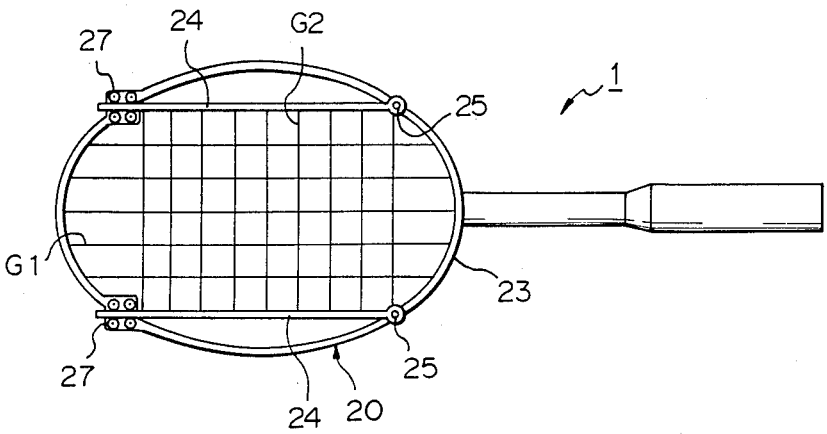
FIG. 3 is a simplified plan view of another embodiment of the racket frame in accordance with the present invention in a free state.

In FIG. 3, a head 20 of the racket frame 1 in accordance with the present invention has a configuration defined by an oval elongated member 23 for longitudinal strings G1 and a pair of opposed elongated members 24 for lateral strings G2. Each of the pair of elongated members 24 is coupled at one end thereof to the oval elongated member 23 by means of pins 25. At the other end, each of the elongated members 24 is coupled to the oval elongated member 23 by means of slide guides 27 each of which includes guide rollers to guide the other end in the direction of the longitudinal strings G1. In the assembled state shown in FIG. 3, the longitudinal strings G1 are held in tension between the opposed sections of the oval elongated member 23, the lateral strings G2 are held in tension between the pair of elongated members 24, and the longitudinal and lateral strings G1 and G2 form a face defined by the head 20.

Figure 4:
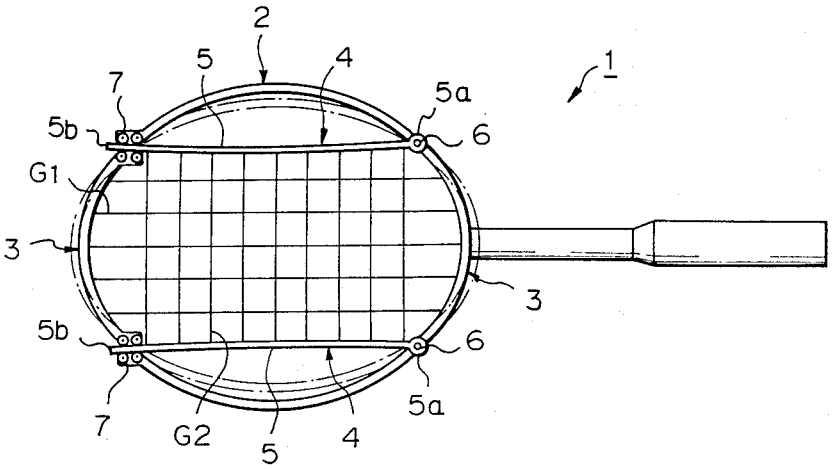
FIG. 4 is a plan view of the racket frame in FIG. 3 with elastic deformation at shooting a ball.

As in the first embodiment, impingement of a ball B on the face causes elastic deformation of the elongated members 23 and 24 as shown in FIG. 4 and such elastic deformation mitigates impulsive load on the strings G1 and G2 via impulsion shearing, thereby providing increased repulsion on balls.

I claim:

1. A racket frame, comprising:

a head frame, a grip and a yoke, the head frame being coupled to the grip via the yoke and defining a bounded ball striking area;

a ball striking face disposed in the ball striking area, the ball striking face being secured to the head frame and comprising a lattice of longitudinal and lateral strings secured to said head frame; and said head frame including a first pair of elongate, opposed and spaced head frame members and hinge means for hingedly securing at least one end of each of said frame members in said head frame in a manner which facilitates flexing of the frame members toward one another, a portion of said lattice of strings secured to said frame members whereby, in response to a striking of said ball striking face by a ball, said frame members flex toward one another to a degree greater than without said hinge means.

2. The racket frame of claim 1, further comprising a second pair of elongate, opposed and spaced frame members, said hinge means hingedly securing said first and second pairs of members to one another, said first and second pairs of members to defining a substantially rectangular ball striking face.

3. The racket frame of claim 2, wherein said hinge means comprises a respective pin disposed at each end region of said first and second pairs of frame members.

4. The racket frame of claim 2, wherein the first pair of frame members flex independently of said second pair of frame members.

5. The racket frame of claim 2, wherein said lateral strings are secured to said first pair of frame members and said longitudinal strings are secured to said second frame members and wherein said longitudinal and lateral strings stretch independently of one another.

6. The racket frame of claim 1, wherein said head frame comprises an oval shaped frame member, wherein said longitudinal strings are secured to said oval shaped member and wherein said first pair of elongated frame members are secured to said oval shaped member and said lateral strings are secured to said first pair of frame members.

7. The racket frame of claim 6, further comprising slide guide means and wherein each of said first pair of frame members is secured to said oval frame at one end thereof by means of said hinge means and at the other end thereof by means of said slide guide means.

8. The racket frame of claim 7, wherein said hinge means comprises pins.

9. The racket frame of claim 7, wherein said slide guide means comprises guide rollers.

* * * * *